US008057128B2

(12) United States Patent
Stankus et al.

(10) Patent No.: US 8,057,128 B2
(45) Date of Patent: Nov. 15, 2011

(54) TRUSS SHOE WITH WEDGE RETAINING SLEEVE AND METHOD OF ASSEMBLING SAME

(75) Inventors: John C. Stankus, Canonsburg, PA (US); John G. Oldsen, Butler, PA (US); Xiaoting Li, Cheswick, PA (US); John Feyrer, Sewickley, PA (US); Dakota Faulkner, Pittsburgh, PA (US); Arthur J. Craven, Grand Junction, CO (US); Demrey G. Brandon, Pittsburgh, PA (US)

(73) Assignee: FCI Holdings Delaware, Inc., Wilmington, DE (US)

( * ) Notice: Subject to any disclaimer, the term of this patent is extended or adjusted under 35 U.S.C. 154(b) by 297 days.

(21) Appl. No.: 12/481,017

(22) Filed: Jun. 9, 2009

(65) Prior Publication Data

US 2010/0310325 A1 Dec. 9, 2010

(51) Int. Cl.
*E21D 21/00* (2006.01)

(52) U.S. Cl. ..... 405/302.2

(58) Field of Classification Search ..... 405/302.1, 405/302.2, 259.1, 259.4, 259.5; 403/374.1, 403/374.2, 374.3, 409.1
See application file for complete search history.

(56) References Cited

U.S. PATENT DOCUMENTS 3,505,824 A 4/1970 White
4,395,161 A 7/1983 Wilson et al.
4,498,816 A 2/1985 Korpela et al.
4,596,496 A 6/1986 Tyrell et al.
4,630,974 A 12/1986 Sherman
4,699,547 A 10/1987 Seegmiller
4,749,310 A 6/1988 White
4,934,873 A 6/1990 Calandra, Jr.
4,946,315 A 8/1990 Chugh et al.
4,960,348 A 10/1990 Seegmiller
5,026,217 A 6/1991 Seegmiller
5,176,473 A 1/1993 Seegmiller
5,302,056 A 4/1994 Calandra, Jr. et al.
5,466,095 A 11/1995 Scott
5,544,982 A 8/1996 Seegmiller
5,755,535 A 5/1998 Fox
5,913,641 A 6/1999 Long
5,967,703 A 10/1999 Stankus et al.
(Continued)

OTHER PUBLICATIONS http://www.dsigroundsupport.com/docs/products.php?content=D1. 1. Apr. 23, 2004.

*Primary Examiner* — Sunil Singh
*Assistant Examiner* — Kyle Armstrong
(74) *Attorney, Agent, or Firm* — The Webb Law Firm

(57) ABSTRACT

A truss shoe for a roof support system includes a bolt receiving section, an intermediate section, and a cable engaging section. The cable receiving section has a passageway having a first open end spaced from, and in facing relationship, to the bolt receiving section and an opposite second end, wherein the passageway has a cone-shaped portion having a decreasing diameter as the distance from the first end of the passageway increases to receive a wedge shaped cable retention assembly. The surface of the intermediate section includes a cut out portion that extends from the first opening of the passageway toward the bolt receiving section and terminating at a riser. A locking tube has one end in the passageway in facing relationship to the retention assembly and the other end in engagement with the riser to prevent the retention assembly from moving out of the first opening of the passageway.

22 Claims, 10 Drawing Sheets

U.S. PATENT DOCUMENTS

| | | | | |
|---|---|---|---|---|
| 6,619,888 | B2 | 9/2003 | Calandra, Jr. et al. | |
| 6,884,005 | B1 | 4/2005 | Seegmiller | |
| 7,261,494 | B2 | 8/2007 | Stankus et al. | |
| 2005/0115188 | A1 | 6/2005 | Wallstein et al. | |
| 2007/0264090 | A1* | 11/2007 | Reschke et al. | 405/288 |
| 2009/0022544 | A1 | 1/2009 | Wallstein et al. | |

* cited by examiner

TRUSS SHOE WITH WEDGE RETAINING SLEEVE AND METHOD OF ASSEMBLING SAME

BACKGROUND OF THE INVENTION

1. Field of the Invention

This invention relates to a truss shoe with a wedge retaining sleeve, and more particularly, to a truss shoe having a wedge retaining sleeve, or locking tube to detachably secure a cable retention assembly in the passageway of a cable receiving section of the truss shoe.

2. Discussion of the Presently Available Technology

Truss-type mine roof supports are well known in the art of supporting the roof of an underground passageway, such as a mine passage. A basic truss system includes one or more rods extending horizontally the width of the mine passage adjacent the roof and connected at their ends to anchor bolts, which extend at an angle adjacent the ribs of the passage into the rock strata over a solid pillar. The rods are tensioned and vertical components of compressive forces are transmitted into the solid material over the pillars, as opposed to the unsupported rock material immediately above the passage.

With this arrangement, a truss system shifts the weight of the rock strata from over the mined-out passage back onto the pillars. Conventionally, holes are drilled into the mine roof at a 45° angle from the horizontal adjacent to the mine rib so that the holes extend into the supported rock structure over a pillar.

Once the holes are drilled at an angle into the strata over the pillars at the rib line, anchor bolts are inserted into the drilled holes and are secured in place using mechanical expansion shell assemblies and/or a resin made from a mixture of a resin component and an epoxy component. Before the bolts are inserted in the drilled holes, truss shoes or bearing blocks are positioned on the bolt at the emergent end of the bolt from the hole. As the bolts are securely anchored in the drilled holes, the bearing surfaces of the truss shoes or bearing blocks are compressed into engagement with the mine roof.

For an uneven mine roof or a roof having severely potted areas, the truss shoe preferably has sufficient bearing surface to contact the mine roof so that the truss shoe is correctly positioned for engagement with the horizontal truss members. Once the truss shoes are securely positioned at the mine roof adjacent the ribs, the horizontal truss members are assembled and connected to the truss shoes. The truss members are tightened to a preselected load to exert tension on the truss members so that the weight of the rock strata over the mined out area beneath the roof is shifted along the horizontal truss members upwardly into the solid rock strata over the pillars at the rib line.

The truss hardware is connected under tension to the truss shoes that are held tightly against the mine roof by the anchored angle bolts. A wide variety of truss hardware is commercially available to form a truss system between the anchored angle bolts. For example and not limiting to the discussion, U.S. Pat. No. 7,261,494 (hereinafter also referred to as "USPN '494") to the Jennmar Corporation discloses a cable truss system including a pair of truss shoes, a pair of inclined bolts, and a truss assembly. Each truss shoe attaches to a roof through an inclined bolt and includes a surface for contacting the roof and a truss supporting member. The truss assembly extends between the truss supporting members of the pair of truss shoes for applying an uplifting force to the roof to support the roof above the passage. The truss assembly includes a pair of cables engaged to the truss shoes attached to the roof.

Several non-limiting embodiments of truss shoes are disclosed in USPN '404. Of particular interest in this discussion is the truss shoes shown in FIGS. 15-18 of USPN '404. In general, the truss shoe includes a bolt receiving end portion to receive the bolt that attaches the truss shoe to the roof and an opposite cable receiving and retaining end portion to receive an end of a cable and to secure the cable to the truss shoe. The cable receiving and retaining end portion includes a tapered passageway for receiving a wedge or cone-shaped retention assembly. The retention assembly has three pieces held together by a flexible band and has an expander to bias the pieces away from one another to pass a cable into an end of the retention assembly.

The retention assembly having the expander is placed in the passageway of the assembly and secured in the passageway by a washer. More particularly, the bottom portion of the washer is placed in a groove formed in the shoe, and the upper portion of the washer is secured in position by a tab bent over the top of the washer. In the event the expander moves out of the retention assembly during the handling and shipping of the truss shoe, or it is necessary or desired to remove the retention assembly from the passageway of the truss shoe, the washer is removed by lifting the tab and lifting the washer from the groove in the truss shoe. After a retention assembly is placed in the passageway, the washer is secured over the passageway as previously discussed.

Although the truss shoes of USPN '494 discussed above are acceptable, there are limitations. More particularly, bending the tab toward or away from the top of the washer causes fatigue of the tab, and the tab brakes from the truss shoe. When the tab breaks from the truss shoe, the washer is usually secured in position by welding the top of the washer to the truss shoe. As is appreciated by those skilled in the art, breaking the weld to release the washer from, and welding the washer to, the truss shoe is time consuming.

As can be appreciated by those skilled in the art, it would be advantageous to provide an arrangement for securing the cable retention assembly in, and for removing the cable retention assembly from, the passageway of the cable receiving section of a truss shoe that does not have the limitations of the presently available arrangements, e.g. the washer and tab or weld arrangement discussed above.

SUMMARY OF THE INVENTION

This invention relates to a truss shoe for use in a mine roof support system. The truss shoe includes, among other things, a one-piece body member having a base member having a bearing surface; a bolt receiving section opposite to the bearing surface and extending upward from the base member, the bolt receiving section including a bore extending through the bolt receiving section and the base member; a cable engaging section opposite to the bearing surface and extending upward from the base member and spaced from the bolt receiving section. The cable engaging section has a passageway therethrough, the passageway having a first open end spaced from, and in facing relationship, to the bolt receiving section and an opposite second end, wherein the passageway has a cone-shaped portion having a decreasing diameter as the distance from the first end of the passageway increases, and an intermediate section opposite to the bearing surface and between the bolt receiving section and the cable receiving section, the intermediate section including a cut out in base of the intermediate portion, the cut out portion extending from the first open end of the passageway toward the bolt receiving section and terminating at a riser.

This invention further relates to a truss shoe for use in a mine roof support system including, among other things, a one-piece body member, having a base member including a bearing surface for engaging a mine roof; a bolt receiving section extending upward from the base member, the bolt receiving section including a bore hole extending through the bolt receiving section and the base member, wherein the bore hole of the bolt receiving section has a first end opening at the bearing surface that is non-circular and an opposite second end opening that is circular. The shoe further includes a cable engaging section spaced from the bolt receiving section, the cable receiving section having a passageway therethrough to receive a portion of a cable. The cable engaging section includes a housing extending upward from the base member and having a first open end facing the bolt receiving section and an opposite second open end, with the passageway between the first end and the second end. The passageway has decreasing distance between wall portions as the distance from the first open end increases to provide a passageway having a predetermined interior surface configuration. The shoe further includes an intermediate section between the bolt receiving section and the cable engaging section, the intermediate section including a pair of spaced ribs between and interconnecting the bolt receiving section and the cable engaging section, and a cut out groove between the ribs. A wedge assembly including at least two parts is mounted in the passageway; an expander mounted in the wedge assembly, and a locking tube having a first end and an opposite sloped second end, the locking tube mounted in the cut out groove, to prevent the wedge assembly from moving out of the first open end of the passageway, wherein the locking tube has an inside diameter and outside diameter sized to retain the wedge assembly in the passageway while allowing the expander to pass through the locking tube.

This invention still further relates to a method of securing a cable in a truss shoe of a mine roof support assembly by, among other things, providing a truss shoe having a one-piece body member including base member having a bearing surface, an opposite surface having a bolt receiving section and a housing spaced from the bolt receiving section. The bolt receiving section has a bore terminating at the bearing surface to provide a hole in the bearing surface. The method further includes inserting a wedge assembly in the passageway of the housing providing a locking tube having a first end, a second end and a longitudinal axis extending from the first end to the second end of the locking tube, wherein the second end of the locking tube lies in a plane generally normal to the longitudinal axis of the locking tube and the second end of the locking tube lies in a plane that subtends an acute angle with the longitudinal axis of the locking tube. The first end of the locking tube is inserted in the passageway with the sloped end in facing relationship to the base member, and rotating the locking member to move the second end of the locking tube into engagement with a riser in the base member to secure the end of the locking tube in the passageway and to prevent the wedge assembly from moving out of the passageway.

DESCRIPTION OF THE PREFERRED EMBODIMENTS

Figure 1:
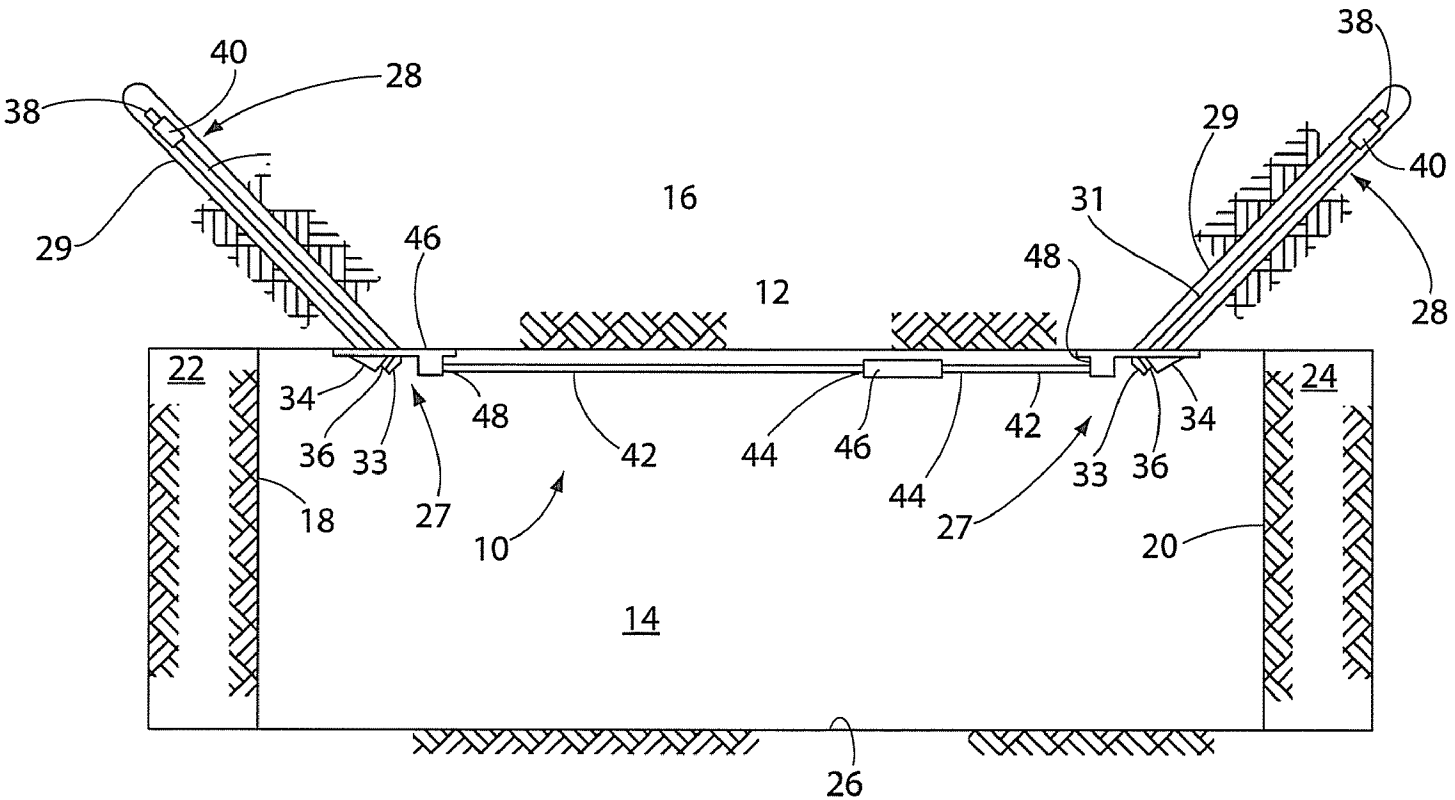
FIG. 1 is a side sectional view of an underground passage having a truss system installed according to the present invention.

A complete understanding of the invention will be obtained from the following description when taken in connection with the accompanying drawing figures wherein, unless indicated otherwise, like reference characters identify like parts throughout. Further, the terminology used herein to discuss the non-limiting embodiments of the invention is for purposes of description and not of limitation.

For purposes of the description hereinafter, the terms "upper", "lower", "right", "left", "vertical", "horizontal", "top", "bottom", "lateral", and derivatives thereof, shall relate to the invention as it is oriented in the drawing figures. However, it is to be understood that the invention can assume various alternative variations and step sequences, except where expressly specified to the contrary. It is also to be understood that the specific devices and processes illustrated in the attached drawings, and described in the following specification, are simply exemplary non-limiting embodiments of the invention. Hence, specific dimensions and other physical characteristics related to the embodiments disclosed herein are not to be considered as limiting. Further, all numbers expressing dimensions, physical characteristics, and so forth, used in the specification and claims are to be understood as being modified in all instances by the term "about". Accordingly, unless indicated to the contrary, the numerical values set forth in the following specification and claims can vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques. Moreover, all ranges disclosed herein are to be understood to encompass any and all subranges subsumed therein. For example, a stated range of "1 to 10" should be considered to include any and all subranges between and inclusive of the minimum value of 1 and the maximum value of 10; that is, all subranges beginning with a minimum value of 1 or more and ending with a maximum value of 10 or less, e.g., 1 to 6.7, or 3.2 to 8.1, or 5.5 to 10.

Referring to FIG. 1, there is illustrated a truss system 10 for supporting a roof 12 above an underground passage or passageway 14 cut in a rock formation 16 by conventional mining methods to extract solid material, such as coal, in a mining operation. The passageway 14 is defined by the roof 12, oppositely positioned side walls 18 and 20 formed by ribs or pillars 22, 24, respectively, that extend between the roof 12, and a floor 26. The portion of the rock formation 16 above the roof 12 is unsupported. The truss system 10 incorporating truss shoe 27 of the invention (see FIG. 2) is installed transversely across the passageway 14 adjacent the roof 12 to provide an uplifting force through the unsupported roof 12 in a manner which is well known in the art by which the weight of the rock formation 16 above the roof 12 is shifted horizontally and redirected to the rock formation 16 supported by the pillars 22 and 24.

As is appreciated, the truss system incorporating features of the invention is not limited to providing an uplifting force to the roof of a passageway, e.g. the passageway 14 can be used to apply a supporting force to the walls of the passageway, e.g. the sidewalls 18 and 20.

The truss system 10 is secured to the mine roof 12 by elongated roof bolt assemblies 28 inserted in bore holes 29 drilled at an angle through the surface of the roof 12 for a predetermined length into the rock formation 16 which is supported by the solid pillars or ribs 22 and 24. In one non-limiting embodiment of the invention, the bore holes 29 are drilled at a 45° angle for a distance of six feet (1.8 meters) or greater into the rock formation 16 spaced within two feet (0.6 meters) from the respective side walls 18 and 20 to end points supported by solid material above the pillars 22 and 24.

One non-limiting roof bolt assembly, e.g., roof bolt assembly 28, that can be used in the practice of the invention and not limiting the invention thereto, includes an elongated roof bolt, e.g., the elongated roof bolt 31, having an enlarged head 33 at one end portion 34, a washer 36 between the enlarged head 33 of the roof bolt 31 and the truss shoe 27, and an opposite threaded end portion 38. A mechanical expansion shell assembly 40 is threadably engaged to the threaded end portion 38 of the bolt 31. As is well known in the art, upon rotation of the roof bolt 31, the shell assembly 40 is expanded into gripping engagement with the wall of the bore hole 29 to exert tension on the elongated roof bolt 31, with the end portion 34 of the bolt 31 bearing against the mine roof 12. To increase the anchorage of the elongated roof bolt 31 of the roof bolt assembly 28 within the bore hole 29, resin can be used in combination with the roof bolt assembly 28 when it is installed, e.g. but not limiting to the invention, as disclosed in U.S. Pat. No. 6,619,888 (hereinafter "USPN '888), which patent is hereby incorporated by reference. The use of resin adds additional strength to the anchorage of the roof bolt 31 of the roof bolt assembly 28 in its respective one of the bore holes 29 when torque is applied to the end portion 34 of the roof bolt 31.

With continued reference to FIG. 1, the truss system 10 further includes cables 42 that extend horizontally between the pair of truss shoes 27 of the invention. One end 44 of each of the cables 42 is joined by a coupler or splice tube 46 of the type used in the art, and the other end 48 of the cables 42 is joined to the truss shoe 27 in accordance to the teachings of the invention.

Figure 2:
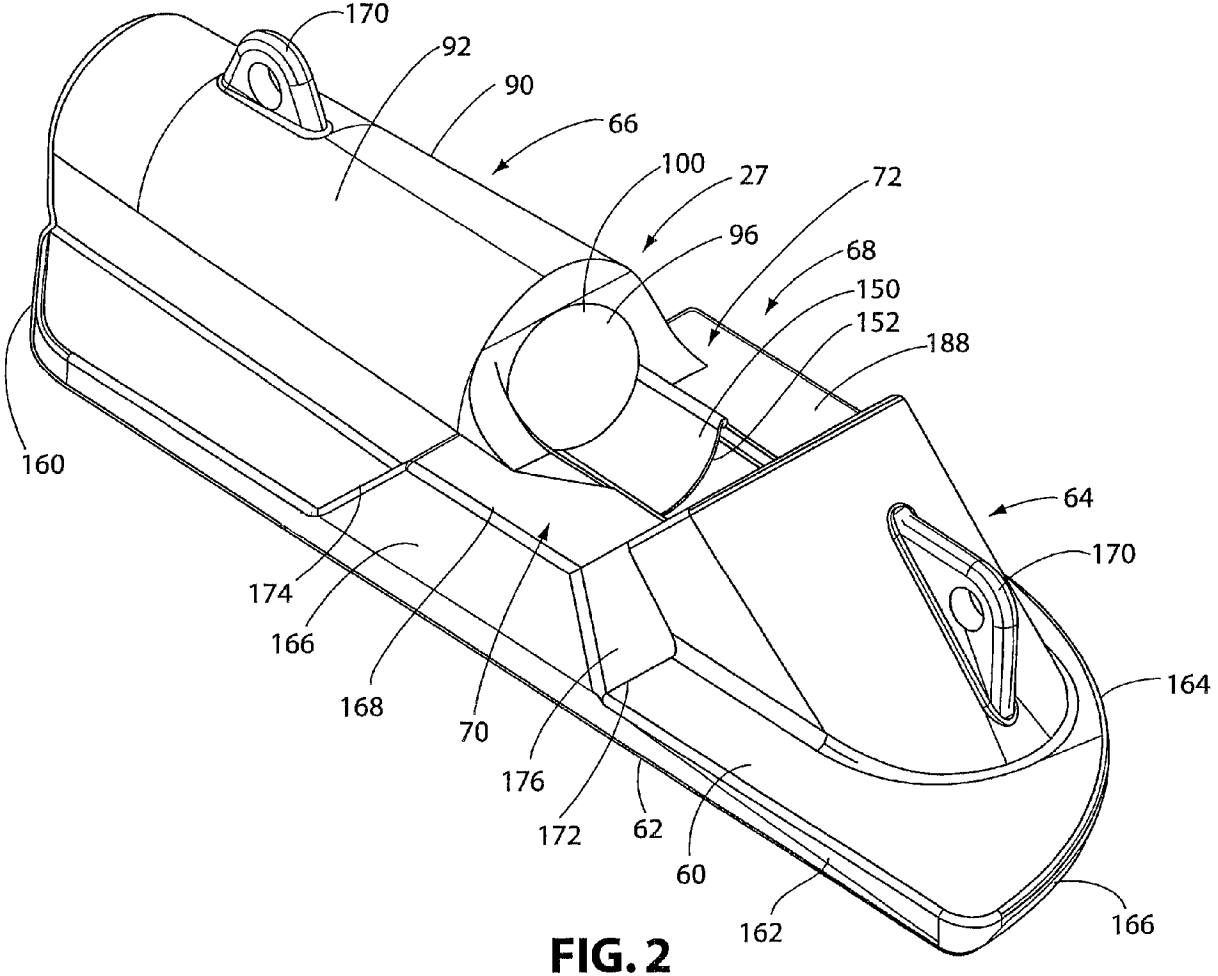
FIG. 2 is an orthogonal view of a non-limiting embodiment of a truss shoe according to the present invention.
Figure 3:
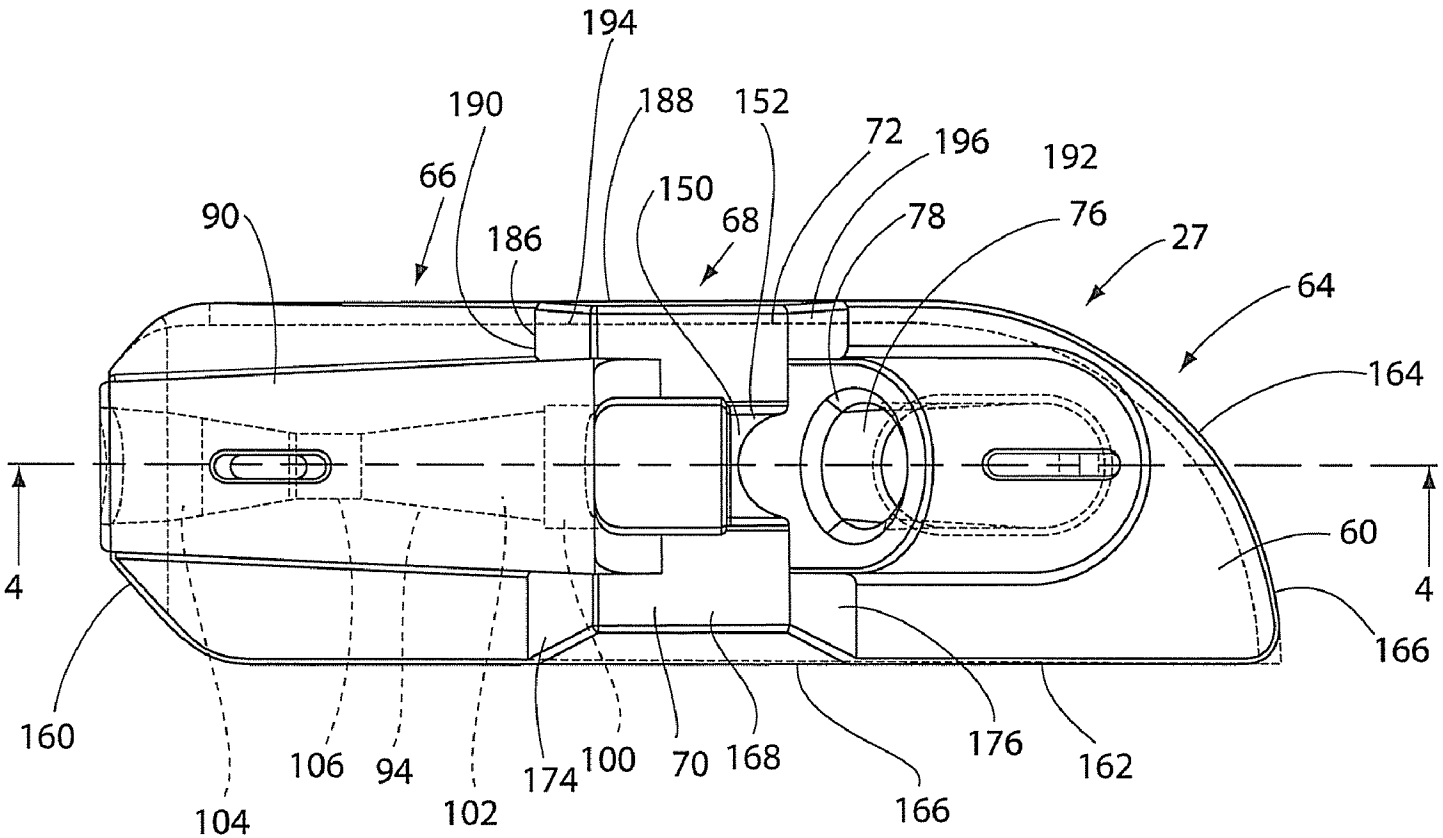
FIG. 3 is plane view of the truss shoe shown in FIG. 2.
Figure 4:
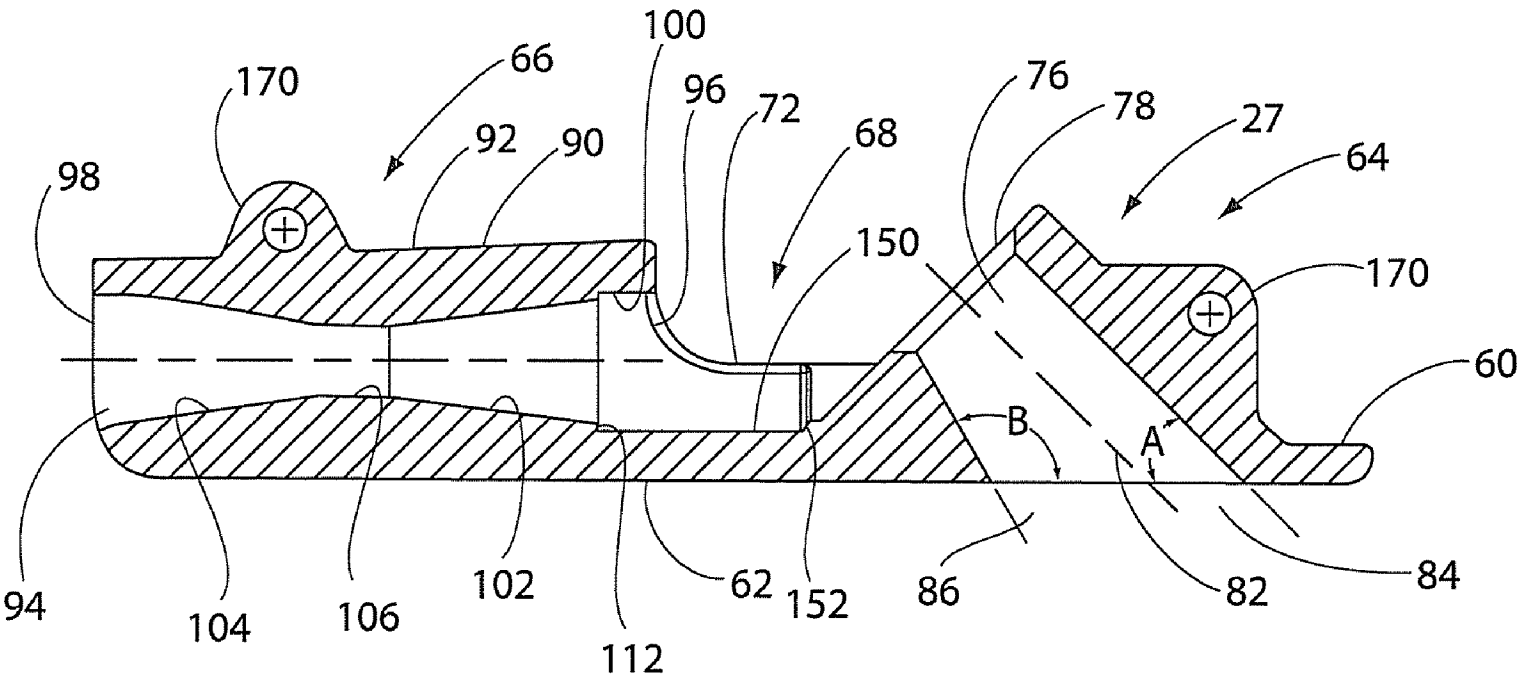
FIG. 4 is a view taken along lines 4-4 of FIG. 3.

With reference to FIGS. 2-4, as needed, in one non-limiting embodiment of the invention, the truss shoe 27 includes a base 60 having bearing surface 62 (see FIGS. 2 and 4), a bolt receiving section 64 extending upward from the base 60, a cable receiving or engaging section 66 also extending upwardly from the base 60 and in spaced relation to the bolt receiving section 64, and an intermediate body section 68 extending from the bolt receiving section 64 to the cable engaging section 66. The intermediate body section 68 includes a pair of spaced side ribs or gussets 70 and 72 extending from the bolt receiving section 64 to the cable engaging section 66. Each one of the side ribs 70 and 72 extends upwardly or outwardly from the base 60 and are connected at one end portion to the bolt receiving section 64 and at the opposite end portion to the cable engaging section 66. The side ribs 70 and 72 provide structural stability to the truss shoe, for example and not limiting to the invention prevent bending of the truss shoe 27 at a position between the bolt receiving section 64 and the cable engaging section 66.

Prior to installation of the elongated roof bolt assembly 28 in the bore hole 29 in the rock formation 16, the end portion 38 of the roof bolt 31 is moved through bore hole 76 in the bolt receiving section 64 of the truss shoe 27 with the enlarged head 33 of the roof bolt 31 and the washer 36 engaging open end 78 of the bore hole 76 of the truss shoe 27. The expansion shell assembly 40 can be threaded onto the threaded end portion 38 of the roof bolt 31 before the roof bolt 31 is moved through the bore hole 76 of the truss shoe 27, or after the roof bolt 41 is moved through the bore hole 76 of the truss shoe 27. The roof bolt 31 having the expansion shell assembly 40 is then inserted upwardly into the angled bore hole 29 in the rock formation 16. The roof bolt assembly 28 is advanced into the bore hole 29 so that the enlarged head 33 moves the washer 36 against the open end 78 of the bore hole 76 of the truss shoe 27 to urge the bearing surface 62 of the truss shoe 27 (see FIGS. 1, 2 and 4) into contact with the roof 12. When the bearing surface 62 of the truss shoe 27 is satisfactorily seated in contact with the roof 12, a torque is applied to the end portion 34 of the roof bolt 31 to expand the shell assembly 40 to anchor the roof bolt assembly 28 in its respective one of the bore holes 29 in the roof 12.

As can be appreciated, the invention is not limited to the manner in which the truss shoe of the invention is secured against the roof 12 of the passageway 14 (see FIG. 1). For example and not limiting to the invention, the techniques disclosed in USPN '888 can be used to set a bolt in each of the bore holes 29 in the rock formation 16. After the bolt is set in the rock formation, the bore hole 76 of the truss shoe 27 is passed over the threaded end of the bolt extending out of the bore hole 29 to bias the bearing surface 62 of the truss shoe 27 against the roof 12, after which a nut is threaded onto the threaded end of the bolt to secure the bearing surface 62 of the truss shoe 27 against the roof 12 of the passageway 14.

With continued reference to FIGS. 2-4 as needed, the discussion is directed to the bore hole 76 in bolt receiving section 64 of the truss shoe 27. As is appreciated by those skilled in the art and as discussed above, the bore holes 29 are drilled into the rock formation 16 at an angle so that threaded end portion 38 of the roof bolt 31 extends over a pillar, e.g., one of the pillars 22 and 24, and the end portion 34 of the bolt 31 extends out of the roof 12 of the passageway 14. To provide for full surface contact, or to maximize surface contact, between bearing surface 62 of the truss shoe 27 and the roof 12 of the passageway 14 (see FIG. 1), centerline 82 (see FIG. 4) of the bore hole 76 of the truss shoe 27 is normal to a plane containing the open end 78 of the bore hole 76 and subtends an angle "A" to the bearing surface 62 of the truss shoe 27 that is the same as, or similar to, the angle subtended by center line of the bore hole 29 in the rock formation 16 and the plane of the roof 12. Although not limiting to the invention, the angle is usually 45°.

With reference to FIG. 4, open end 84 of the bore hole 76 at the bearing surface 62 of the truss shoe 27 has an enlarged opening for ease of inserting the roof bolt 31 or the roof bolt assembly 28 into the bore hole 29 in the rock formation 16. For example and not limiting to the invention, the open end 84 of the bore hole 76 at the bearing surface 62 of the truss shoe 27 has a diameter of 1.75 inches (4.45 centimeters); the diameter decreases for a distance of 0.188 inch (0.48 centimeter) to a diameter of 1.375 inches (3.49 centimeters) at the open end 78 of the bore hole 76 of the truss shoe 27. The shape of the bore hole 76 as it extends toward the bearing surface 62 of the truss shoe 27 changes from a circular configuration at the open end 78 to an elliptical configuration at the open end 84 so that the roof bolt assembly 28 as it is moved into the bore hole 29 in the rock formation 16 has some degree of free movement to accommodate those instances where the bearing surface 62 of the truss shoe 27 and the roof 12 are not parallel to one another. The conversion from a circular bore to an elliptical bore is not limiting to the invention. In one non-limiting embodiment of the invention, the angle "A" is 45°, whereas opposite wall of the bore hole 76 lying along line 86 (see FIG. 4) and the bearing surface 62 subtend an angle "B" of 60°. Preferably, but not limiting to the invention, the interior wall portions of the bore hole 76 between the open ends 78 and 84 of the bore hole 76 of the truss shoe 27 are contoured to provide a seamless transition from the circular open end 78 to the elliptical open end 84 of the bore hole 76.

With continued reference to FIG. 4, the cable engaging section 66 includes a housing 90 extending upwardly or outwardly from the base 60 of the truss shoe 27. In one non-limiting embodiment of the invention, the housing 90 has a rounded outer upper surface 92 (see FIG. 2) and a passageway 94 extending through the housing 90. The passageway 94 has a first open end 96 in facing relationship to, and spaced from, the circular open end 78 of the bore hole 76 of the truss shoe 27 and an opposite second open end 98. The passageway 94 has a first circular portion 100, a first cone-shaped portion 102, a second cone-shaped portion 104 and a second circular portion 106. In one non-limiting embodiment of the invention, the first circular portion 100 is at the first open end 96 of the passageway 94, the first cone-shaped portion 102 is between the first and second circular portions 100 and 106, respectively, and the second cone-shaped portion is between the second circular portion 106 and the second open end 98 of the passageway 94.

The first circular portion 100 at the first open end 96 of the passageway 94 has a constant diameter for a given distance, and the diameter is sized to receive end 108 of locking tube or wedge retaining sleeve 110 (see FIG. 5) discussed in detail below. The first cone-shaped portion 102 has a decreasing diameter as the distance from the first open end 96 of the passageway 94 increases. The diameter of the first cone-shaped portion 102 adjacent the first circular portion 100 has a diameter slightly less than the diameter of the first circular portion 100 to provide a ledge 112 to engage the end 108 of the locking tube 110 to prevent the locking tube 110 from moving into the first cone-shaped portion 102. The first cone-shaped portion terminates at the second circular portion 106. The second circular portion has a constant diameter for a given distance, and the diameter is sized to guide the end 48 of the cable 42 into a cable retention assembly 114 (see FIGS. 6 and 7) captured in the first cone-shaped portion 102 of the passageway 94 in a manner according to the teachings of the invention discussed below. The diameter of the second cone-shaped portion 104 increases as the distance from the first open end 96 of the passageway 94 increases, or as the distance from the second open end 98 of the passageway 94 decreases. Preferably but not limiting to the invention, the transition from the first cone-shaped portion 102 to the second circular portion 106, or vise versa, and from the second circular portion 106 to the second cone-shaped portion 104, or vise versa, is a seamless transition for ease of moving the end 48 of the cable 42 from the second cone-shaped portion 104 through the second circular portion 106 into the cable retention assembly 114 (see FIGS. 6 and 7) captured in the first cone-shaped portion 102.

Figure 6:
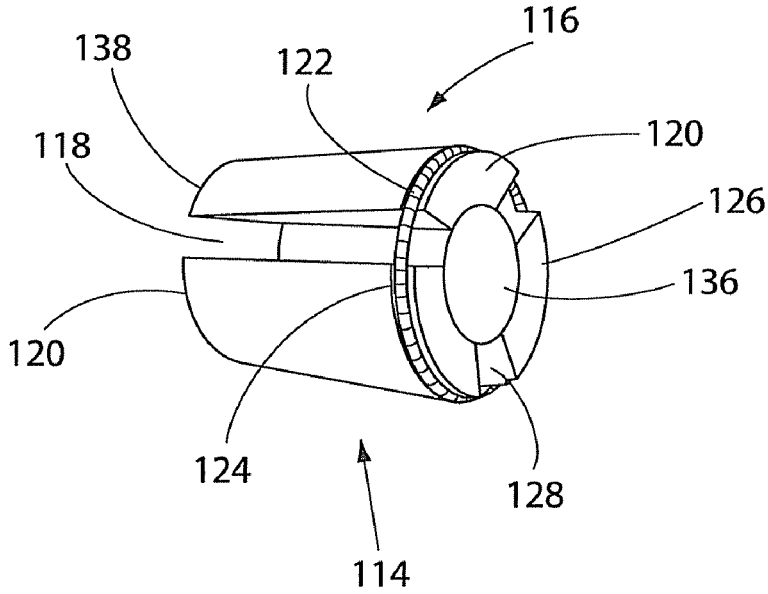
Figures 7, 7A:
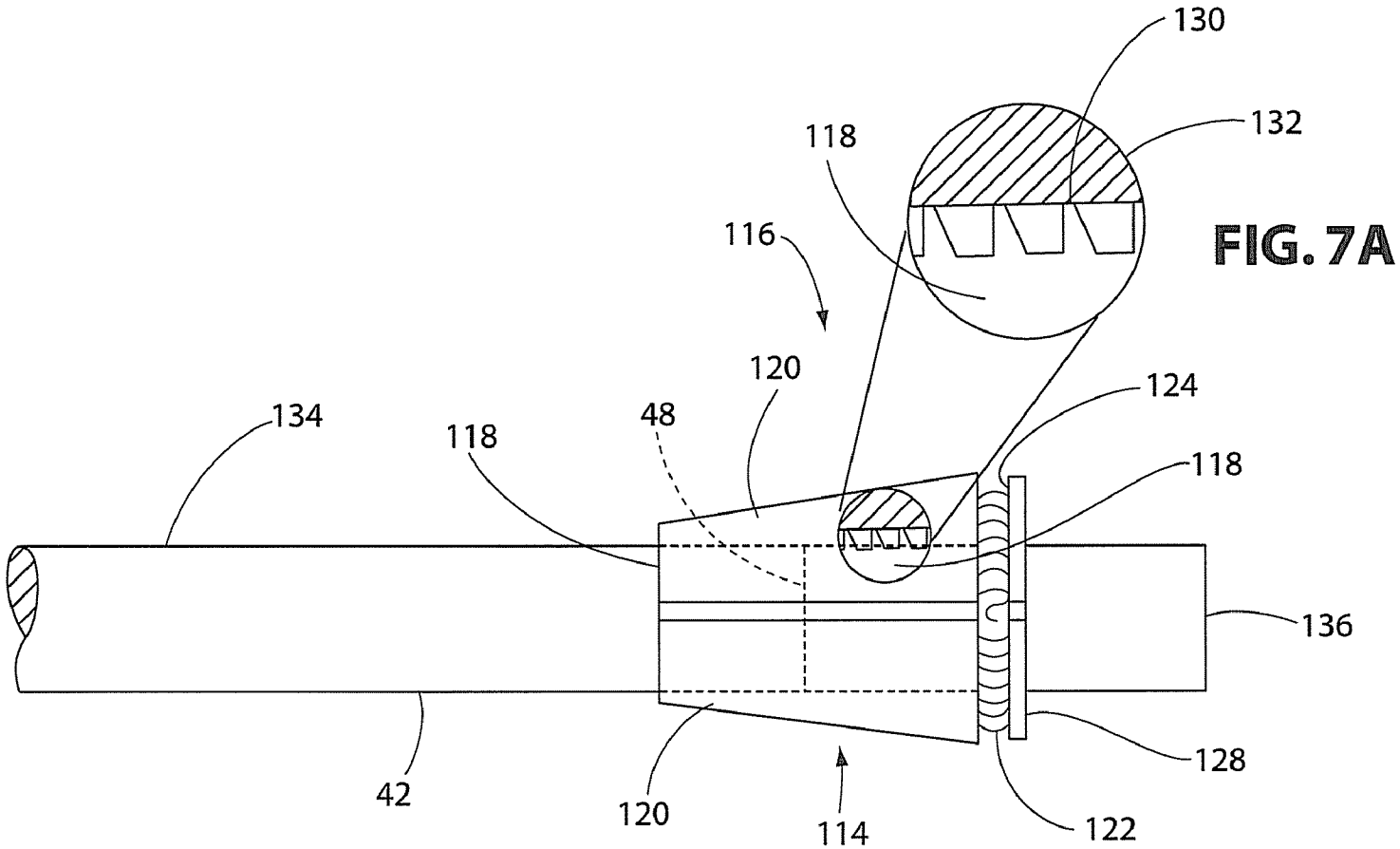
FIG. 7 is a side elevated view of the cable retention assembly shown in FIG. 6 mounted on a cable and having an exploded interior view of the assembly for purposes of clarity.

With reference to FIGS. 6 and 7 the discussion is directed to the cable retention assembly 114. In one non-limiting embodiment of the invention, the cable retention assembly 114 includes a cable retainer 116 having a cone-shaped outer surface sized to fit into the first cone-shaped portion 102 of the passageway 94 of the housing 90 of the truss shoe 27 (see FIG. 8). For ease of inserting the end 48 of the cable 42 into passageway 118 of the cable retainer 116, the cable retainer 116 is made up of two or three or more, and preferably 2 or 3 segments or parts 120 joined together by a spring band or rubber O-ring 122 mounted in groove 124 as shown in FIGS. 6 and 7 adjacent to larger end 128 of the segments 120. The spring band 122 holds the segments 120 together for ease of inserting the cable retention assembly 114 into the first cone-shaped portion 102 of the passageway 118. With the segments 120 of the cable retainer 116 held together, the outer surface of the cable retention assembly 114 has a cone shape, and the passageway 118 of the cable retention assembly 114 is a circular passageway 118 having a constant diameter when the segments 120 are moved together.

Optionally inner surfaces 124 of the passageway 118 of the cable retainer 116 can be provided with a rough surface, e.g. and not limiting to the invention, with teeth 132 (shown only in FIGS. 7 and 7A) angled toward end 128 of the cable retainer 116 to engage outer surface 134 of the cable 42 and to secure the cable 42 in position in the cable retention assembly 114. For ease of moving the end 48 of the cable 42 into the cable retainer 116 of the cable retention assembly 114, an expander 136 is positioned in the passageway 118 of the cable retainer 116. As is appreciated, the cable retention assembly 114 without the spring band 72 holding the ends 128 of the segments 120 together can be used in the practice of the invention.

In one non-limiting embodiment of the invention, the diameter of the second circular portion 106 of the passageway 94 of the housing 90 of the truss shoe 27 (see FIGS. 4 and 9) is less than the outside diameter of end 138 of the cable retention assembly 114 with the segments 120 of the cable retainer 116 moved together, and the diameter of the second circular portion 106 is equal to or larger than the diameter of the passageway 118 of the cable retention assembly 114 with the segments 120 of the cable retainer 116 moved together. In this manner, the cable retention assembly 114 is prevent from moving into the second circular portion 106 of the passageway 94, and the end 48 of the cable 42 can move through the second circular portion 106 of the passageway 94 into the passageway 118 of the cable retention assembly 114. In this non-limiting embodiment of the invention, the diameter of the cable is 0.60 inch (1.5 centimeters); the diameter of the second circular portion 106 of the passageway 94 is 0.70 inch (1.75 centimeters), the outside diameter of the end 138 of the cable retention assembly 114 with the segments 120 of the cable retainer 116 moved together is 0.80 inch (2.0 centimeters), and the outside diameter of the end 136 of the cable retention assembly 114 with the segments 120 of the cable retainer 116 moved together is 1.06 inches (2.56 centimeters). The diameter of the passageway 118 of the cable retention assembly 114 with the segments 120 of the cable retainer 116 moved together is 0.53 inch (1.35 centimeter), and the diameter of the expander 136 of the cable retention assembly 114 is 0.63 inch (1.6 centimeters) for a cable diameter of 0.60 inch (1.5 centimeters). Although not limiting to the invention the cable retainer 116 is made of metal.

In one non-limiting embodiment of the invention, the length of the cable retaining assembly 114 is 1.6 inches (4.1 centimeters). Preferable the length of the first cone-shaped portion 102 of the passageway 94 of the housing 90 is greater than the length of the cable retention assembly 114 as measured between the ends 128 and 138 of the cable retention assembly 114. With this arrangement, the cable retention assembly 114 can move toward the first circular portion 100 of the passageway 94 to provide the segments 120 of the cable retention assembly 124 room to expand as the cable end 48 is moved into the passageway 118 of the cable retention assembly 114 to move the expander 136 out of the passageway 118. After the expander 136 is moved out of the passageway 118, the cable 42 is pulled away from the truss shoe 27 to move the cable retention assembly 114 toward the second circular portion to move the segments 120 of the cable retainer 116 toward one another to bias the friction surface 132 against the outer surface 134 of the cable 42 to secure the cable 42 in the housing 90 of the truss shoe 27. In one non-limiting embodiment of the invention, the length of the first cone-shaped portion 102 of the passageway 94 is 2 inches (5.1 centimeters), and the length of the passageway 118 of the cable retention assembly 114 as measured between the ends 128 and 138 of the cable retention assembly 114 is 1 9/16 inches (4 centimeters).

Figure 5:
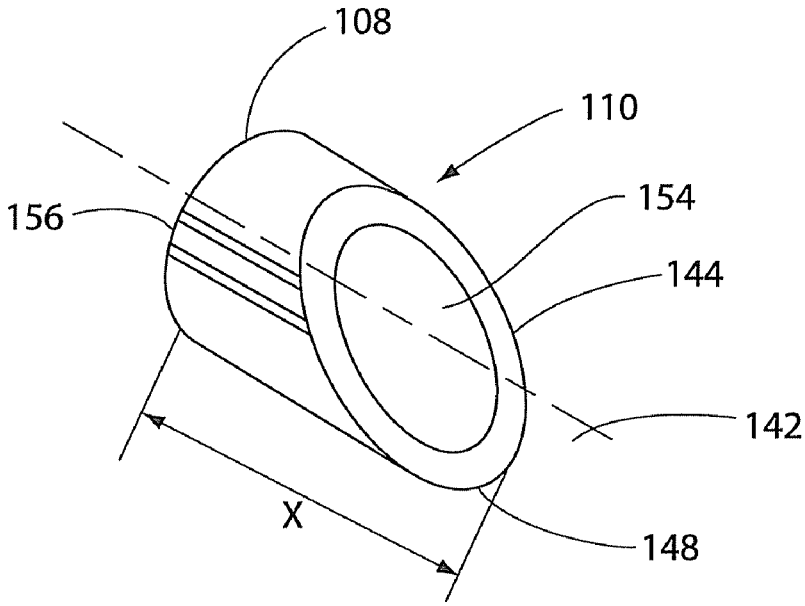
FIG. 5 is an orthogonal view of a wedge retaining sleeve or locking tube of the invention FIG. 6 an orthogonal view of a cable retention assembly that can be used in the practice of the invention.
Figure 8:
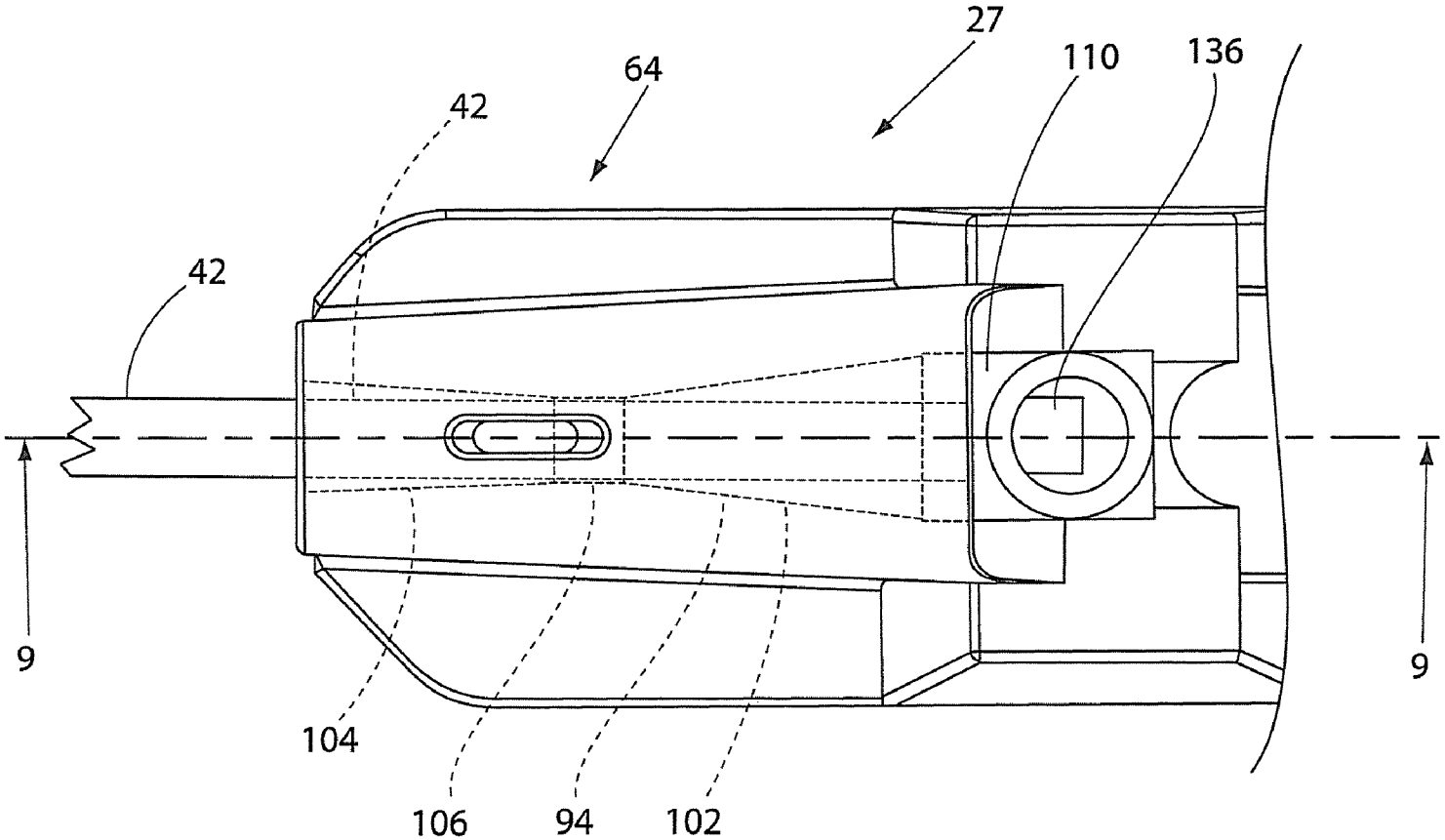
FIG. 8 is a plane view of the cable receiving section and intermediate body section of the truss shoe of the invention showing the wedge retaining sleeve or locking tube of FIG. 5 securing the cable retention assembly of FIG. 6 in the passageway of the cable retention section of the truss shoe.
Figure 9:
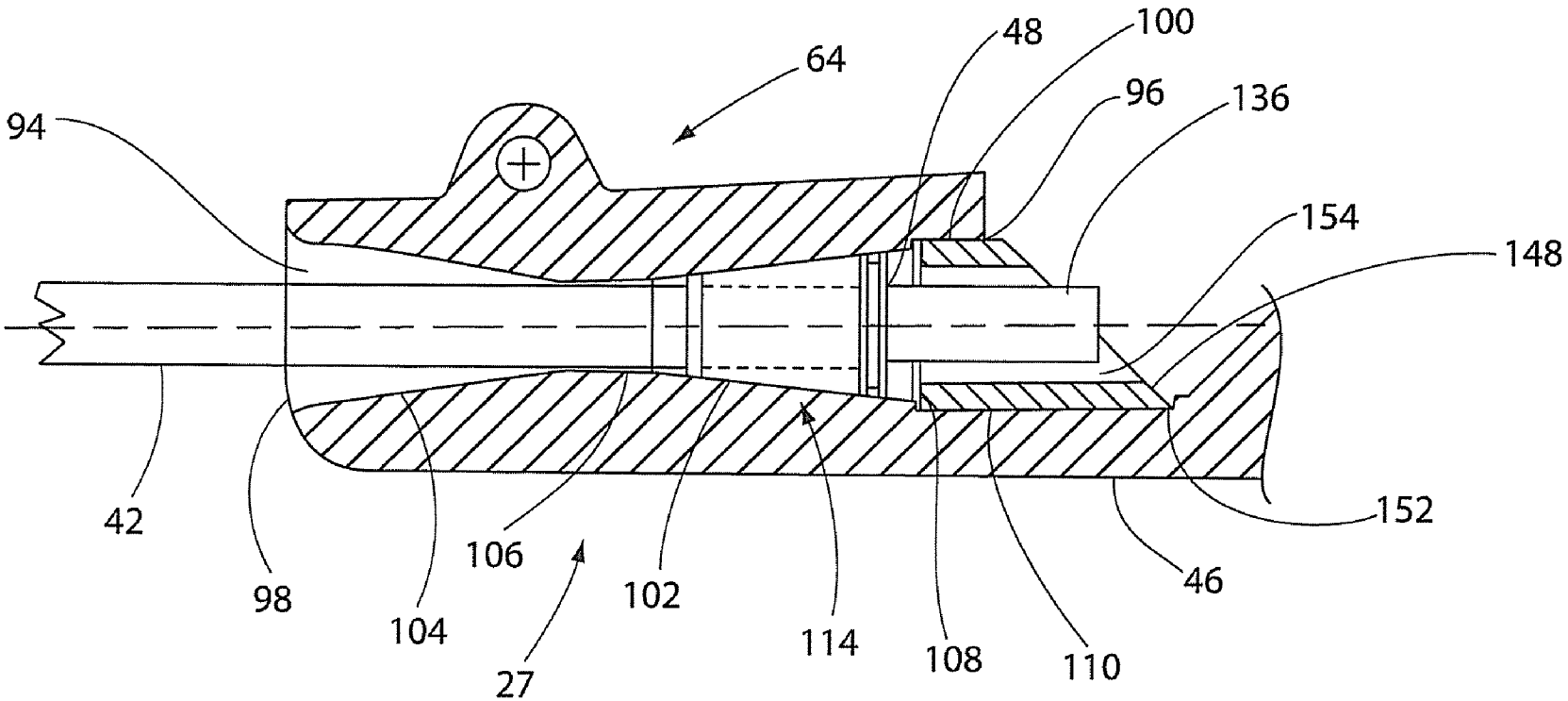
FIG. 9 is a view taken along lines 9-9 of FIG. 8.

With reference to FIGS. 5, 8 and 9 as needed, the discussion is directed to the locking tube or wedge retaining sleeve 110 of the invention to prevent the cable retention assembly 114 from moving out of the first open end 96 of the passageway 94 of the housing 90 of the truss shoe 27. In one non-limiting embodiment of the invention, the locking tubing 110 has the end 108 that is inserted into the first circular portion 100 of the passageway 94 (see FIG. 9) lying in a plane that is normal to longitudinal axis 142 of the locking tube 110, and an opposite sloped end 144 that lies in a plane that subtends an angle of less than 90° with the longitudinal axis 142 of the locking tube 110. The outside diameter of the end 108 of the locking tube 110 is about equal to the inside diameter of the first circular portion 100 of the passageway 94. In one non-limiting embodiment of the invention, the first circular portion 100 of the passageway 94 has a diameter of 1.34 inches (3.4 centimeters), and the end 108 of locking tube 110 has an outside diameter of 1.20 inches (3.0 centimeters). Although not limiting to the invention, the inside diameter of the locking tube is sized to pass expander 136 and cable 42 having diameters in a predetermined range, e.g. and not limiting to the invention, ½ to 1 inch (1.72 to 2.54 centimeters), e.g., 0.60 inch (0.10 centimeter). With this arrangement, one size locking tube 110 can be used with different sized expanders 136 and cables 42. Optionally the end 108 of the locking tube 110 can be beveled for ease of moving the end 108 of the locking tube 110 into the first circular portion 100 of the passageway 94.

In general, the locking tube 110 is locked, or secured, or detachably secured, in position by inserting the end 108 of the locking tube 110 into the first circular portion 100 of the passageway 94 and rotating the locking tube to move end portion 148 of the end 144 of the locking tube 110 into engagement with a riser 152 below the open end 78 of the bore hole 76 of the truss shoe 27 (see FIG. 9). More particularly, and with reference to FIGS. 2, 4 and 9, as needed, in one non-limiting embodiment of the invention, the intermediate body section 68 of the truss shoe 27 between the ribs 70 and 72 (see FIG. 2) has a cutout 150 having a radius equal to the radius of the first circular portion 100 of the passageway 94. The length of the cut out 150 measured between the ledge 112 of the first circular portion 100 and the riser 152 (see FIGS. 2, 4 and 9) is equal to the length between the end 108 and the end portion 148 of the end 144 of the locking tube 110, e.g. measured along the line designated by the letter X in FIG. 5. In one non-limiting embodiment of the invention, the length of the cutout 150 and the length of the line X is 2 inches (5.08 centimeters), the length of the first circular portion 100 is 0.50 inch (1.27 centimeter) and the height of the riser 152 is 3/16 inch (0.48 centimeters).

As can now be appreciated, the invention is not limited to the height of the riser 152 and the length of the cut out 150. To prevent the end portion 148 of the end 144 of the locking tube 110 from moving above the riser when the truss shoe is handled, the height of the riser preferable is made higher as the difference between the outside diameter of the end 108 of the locking tube 110 and the diameter of the first circular portion 100 increases and/or the length of the locking tube increases.

Figure 10:
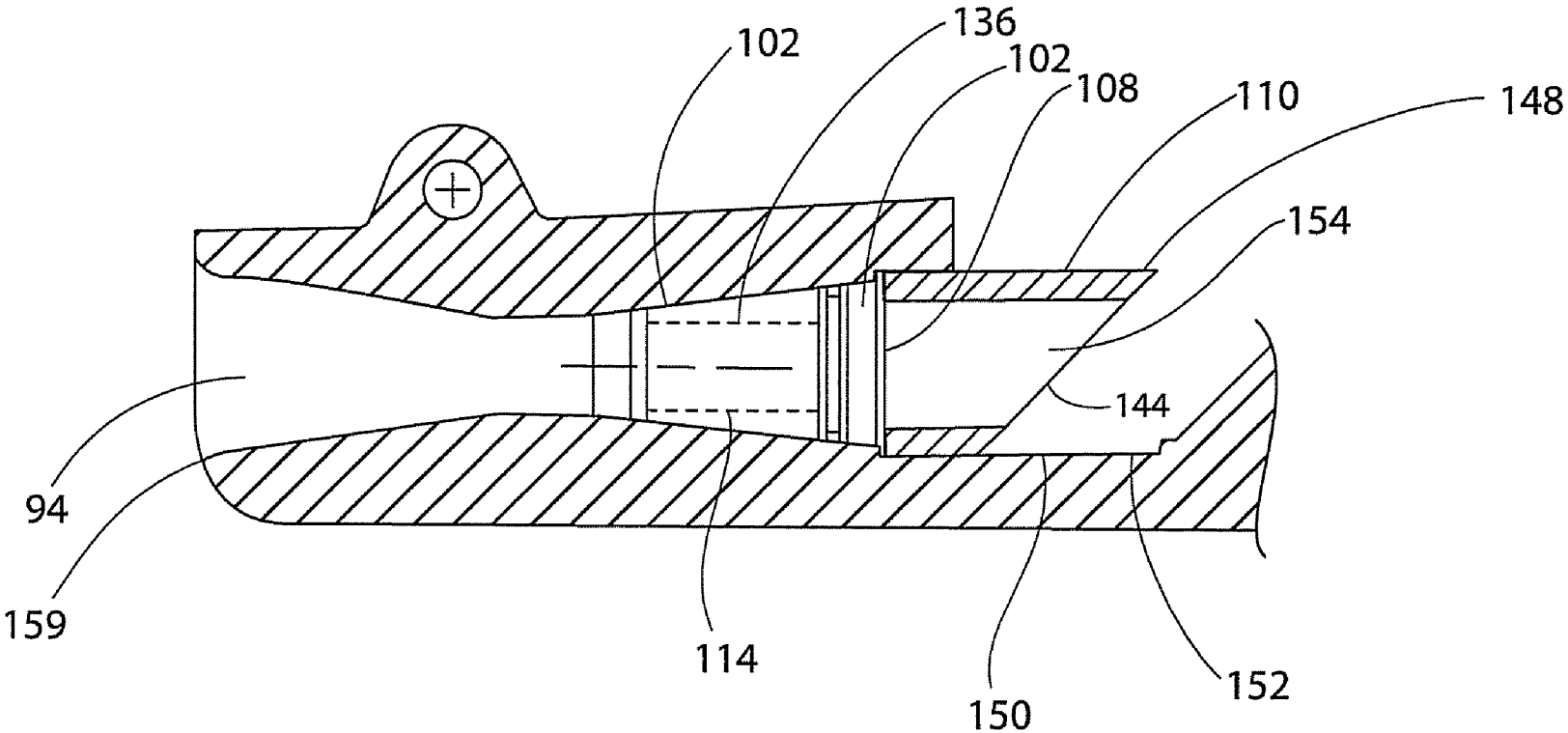
FIG. 10 is a view similar to the view of FIG. 9 showing the wedge retaining sleeve of FIG. 5 in the non-engaging position in accordance to the teachings of the invention.
Figure 11:
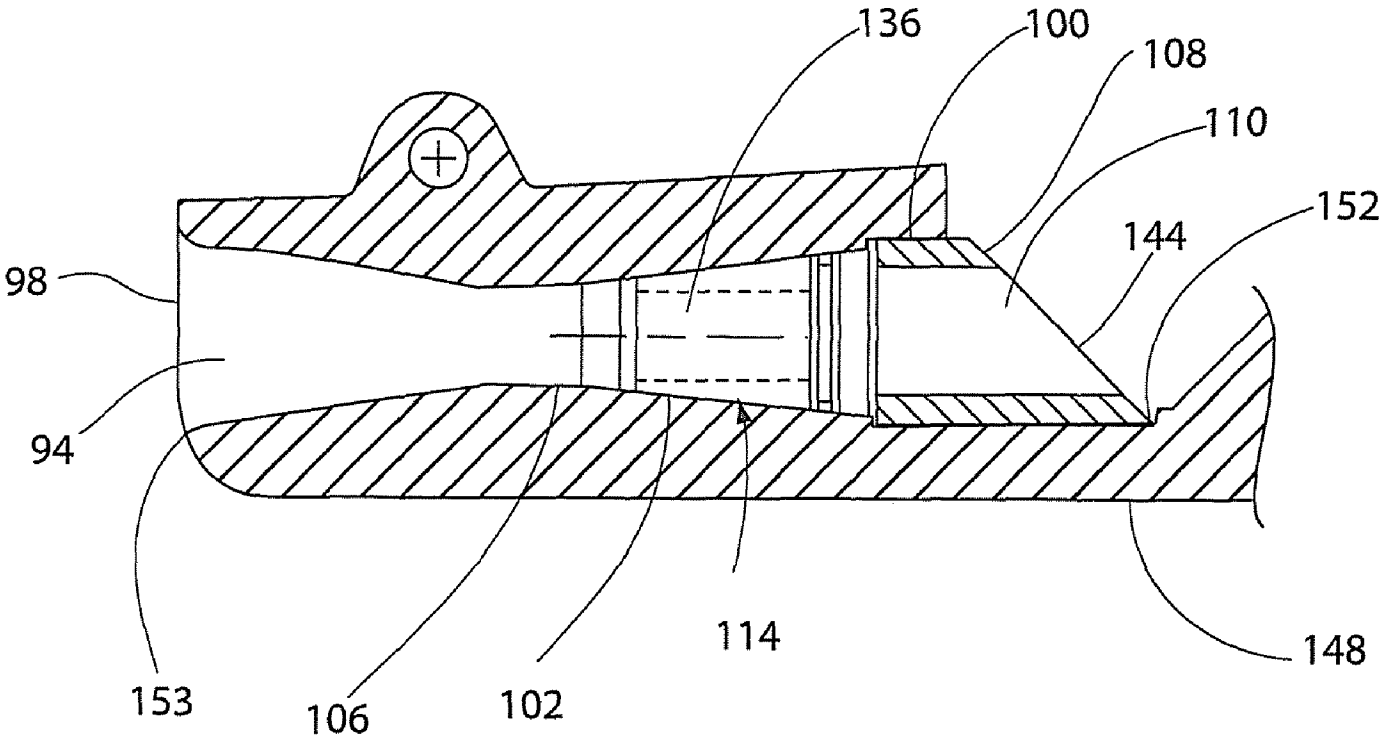
FIG. 11 is a view similar to the view of FIG. 9 showing the wedge retaining sleeve of FIG. 5 in the engaging position.

With reference to FIGS. 10 and 11, the retention assembly 114 having the expander 136 is moved through the open end 96 of the passageway 94 into the first cone-shaped portion 102 of the passageway 94. The locking tube 110 is rotated to position the sloped surface 144 in facing spaced relationship to the cut out 150 (see FIG. 10). The end 108 of the locking tube 110 is moved into the first circular portion 100 of the passageway 94, and the locking tube 110 is rotated 180° to move the end portion 148 of the sloped end 144 of the locking tube 110 into engagement with the riser 152 to secure or capture the cable retention assembly 114 in the first cone-shaped portion 100 of the passageway 94.

In general, the truss system 10 using the truss shoe 27 of the invention is assembled in the following manner. The cable retention assembly 114 having the expander 136 is captured in the first cone-shaped passageway 102 of the cable receiving section 66 of the truss shoe 27, and the bolt receiving section 64 of the truss shoe 27 is bolted to the roof 12 of the underground passageway 14, as previously discussed. With reference to FIG. 11, the end 48 of the cable 42 (see FIG. 9) is moved through the second open end 98 of the passageway 94 into the second cone-shaped portion 104 of the passageway 94, through the second circular portion 106 into the end 139 of the cable retention assembly 114 against the expander 136 (see also FIG. 7). Continued movement of the cable 42 into the passageway 118 of the cable retention assembly 114 moves the expander 136 out of the passageway 118 (see FIG. 9) and through passageway 154 of the locking tube 110. The expander 136 drops out from between the ribs 70 and 72 of the truss shoe 27 (see FIG. 2) or is pulled out. With reference to FIG. 11, the surface of the second cone-shaped portion 104 at the second open end 98 of the passageway 94 has a sloped surface 153 (see FIG. 10) for ease of feeding the cable into the open end 98 of the passageway. Further the length of the second cone-shaped portion 104 is preferably equal to or greater than 2 inches (5.08 centimeters) for ease of guiding the end 48 of the cable 42 into the second circular portion 106 of the passageway 94.

The locking tube 110 retains the cable retaining assembly 114 in the passageway 94 of the housing 90 of the cable engaging section 66 of the truss shoe 27. After the cable end 58 has moved through the cable retention assembly 114, the cable 42 is pulled away from the second open end 98 of the passageway 94 to secure the cable 56 in the cable retention assembly 114, which is secured in the first cone-shaped portion 102 of the passageway 94 of the truss shoe 27. The opposite end of the cable end 44 is secured to the coupler 46 (see FIG. 1).

As can now be appreciated, the cable retention assembly 114 can be removed from the first cone-shaped portion 102 of the passageway 94 by rotating the locking tube 110 180° to move the end portion 148 of the locking tube 110 away from the riser 152 and to position the slope end 144 of the locking tube 110 in spaced facing relationship to the cutout 150 (see FIG. 10). The end 108 of the locking tube 110 is removed from the first circular portion 100 of the passageway 94, after which the cable retention assembly 114 is moved out of the passageway 94.

As can now be appreciated, outer surface of the locking tube 110 can be provided with a rough surface, e.g. but not limiting to the invention, ribs 156 (only two shown in FIG. 5). The locking tube 110 can be made of any rigid material, e.g. but not limited to plastic, fiber reinforced plastic or metal. The locking tube can be formed or machined. In one-non limiting embodiment of the invention, the locking tube 110 is cut from plastic tubing.

In the preferred embodiment of the invention, the truss shoe 27 having the base 60, the bolt receiving section 64, the intermediate section 68, and the cable engaging section 66 is a formed, one-piece truss shoe 27 (see FIG. 2). The invention is not limited to the manner in which the truss shoe 27 is formed, e.g. and not limiting to the invention, the truss shoe of the invention can be cast or machined. The invention further contemplates individually forming the base 60, the bolt receiving section 64, the cable engaging section 66, and the intermediate section 68, and thereafter securing the sections on the base 60 using adhesives and/or mechanical securing arrangements, e.g., nails, screws, nuts, and bolts. Further, as can be appreciated, the invention is not limited to any type of material to make the truss shoes, however, the material selected should provide sufficient structural stability to provide the roof support required and to meet all safety standards. In the preferred practice of the invention, the truss shoe is made of metal, e.g., steel.

As can be appreciated, the invention is not limited to the dimensions of the truss shoe 27 of the invention, and the truss shoe should be large enough to provide a bearing surface 62 having an area sufficient to span recesses in the roof 12 (see FIG. 1). More particularly, in many underground passageways or excavations, the surface of the roof 12 can be very uneven or exhibit severely potted areas formed during the excavation operation. Therefore, it is recommended that the truss shoe 42 have a bearing surface 62 of a sufficient area (e.g., at least 36 square inches (232 square centimeters) and/or 4 inches (10.2 centimeters) by 10 inches (25.4 centimeters)) to prevent the bearing surface 62 from becoming distorted or pulled into a recess in the roof 12 when the roof bolt 27 is tensioned. While the truss shoe 42 is shown in FIG. 1 with the bearing surface 62 in a substantially horizontal position, it is appreciated by those skilled in the art that it is not uncommon for the truss shoe 42 to be substantially inclined or displaced from the preferred horizontal position.

With reference to FIGS. 2 and 3, end 160 of the base 60 adjacent the cable receiving section 66 is rounded for ease of moving the truss shoe about the roof bolt assembly 28 (see FIG. 1), e.g., not engaging the roof 12 of the passageway 14 when the roof has a slope toward the floor 26. The base 60 has one side, e.g., side 162, longer than opposite side, e.g., opposite side 164, to provide end 166 of the base 60 adjacent the bolt receiving section 64 with an arcuate edge or a sweeping radius as clearly shown in FIGS. 2 and 3. The side 164 is beveled as shown in FIG. 3. The sweeping radius at the end 166, the beveled side 164, and the rounded end 160 assist in moving the truss shoe 27 into the installation position. Optionally the truss shoe 27 can be provided with hanger holes 170 (see FIGS. 2 and 3) for hanging accessory equipment, e.g. electric cables, lights, and conduits to the truss shoes.

As can now be appreciated, the invention is not limited to the shape or the dimensions of the side ribs 70 and 72, however, the side ribs 70 and 72 should be sized to provide structural stability to the truss shoe, for example and not limiting to the invention to prevent bending of the truss shoe at a position between the bolt receiving section 64 and the cable engaging section 66 (see FIGS. 2 and 3). With reference to FIG. 3, in one non-limiting embodiment of the invention, the side rib or gusset 70 has a bottom portion 166 and a top portion 168. The bottom portion 166 has an end 174 that extends and is connected to the cable receiving section 66, and an opposite end 176 that extends and is connected to the bolt receiving section 64. The bottom portion 166 of the rib 70 extends to the side 162 of the base 60 of the truss shoe 27. Downwardly sloping sides 174 and 176 as viewed in FIG. 3 extend between the bottom and the top portions 166 and 168, respectively. The top portion 168 extends between and is connected to the cable receiving section 66 and the bolt receiving section 64, and ends short of the cut out 150 (see FIG. 3). The rib or gusset 72 has a bottom portion 186 and a top portion 188. The bottom portion 186 has an end 190 that extends and is connected to the cable receiving section 66, and an opposite end 192 that extends and is connected to the bolt receiving section 64. The bottom portion 186 of the rib 72 extends to the side 164 of the base 60 of the truss shoe 27. Downwardly sloping sides 194 and 196 as viewed in FIG. 3 extend from the bottom portion 186 and the top portion 188. The top portion 188 of the rib 72 extends between and is connected to the cable receiving section 66 and the bolt receiving section 64, and ends short of the cut out 150 (see FIG. 3). The gussets 70 and 72 extending to the sides 162 and 164 of the base 60 of the truss shoe 27 and extending between and connecting the cable engaging section and the bolt receiving section provide additional structural stability to the truss shoe.

It will be understood by those skilled in the art that while the foregoing description set forth in the detailed non-limiting preferred embodiments of the present invention, modifications, additions, and changes can be made thereto without departing from the spirit and scope of the invention.

The invention claimed is:

1. A method of securing a cable in a truss shoe of a mine roof support assembly, comprising:

providing a truss shoe comprising a one-piece body member comprising a base member having a bearing surface, an opposite surface having a bolt receiving section and a housing spaced from the bolt receiving section, the bolt receiving section having a bore hole terminating at the bearing surface to provide a hole in the bearing surface;

inserting a wedge assembly in passageway of the housing;

providing a locking tube having a first end, a second end and an longitudinal axis extending from the first end to the second end of the locking tube, wherein the first end of the locking tube lies in a plane generally normal to the longitudinal axis of the locking tube and the second end of the locking tube lies in a plane that subtends an acute angle with the longitudinal axis of the locking tube;

inserting the first end of the locking tube in the passageway with the sloped end in facing relationship to the base member, and rotating the locking member to move the second end of the locking tube into engagement with a riser in the base member to secure the first end of the locking tube in the passageway and to prevent the wedge assembly from moving out of the passageway.

2. The method according to claim 1, further comprising:

passing a roof bolt assembly through the bore hole of the truss shoe;

securing the bolt assembly and truss shoe to a mine roof;

moving a cable end through the wedge assembly and out of the passageway into the locking tube; and pulling the cable out of the passageway to move the wedge assembly away from the locking tube to compress the wedge assembly against the cable to retain portions of the cable end in the passageway of the truss shoe.

3. A truss shoe for use in a mine roof support system, the truss shoe comprising:

a one-piece body member, comprising:

a base member comprising a bearing surface;

a bolt receiving section opposite to the bearing surface and extending upward from the base member, the bolt receiving section comprising a bore hole extending through the bolt receiving section and the base member;

a cable engaging section opposite to the bearing surface and extending upward from the base member, and spaced from the bolt receiving section, the cable engaging section having a passageway therethrough, the passageway having a first open end spaced from, and in facing relationship to, the bolt receiving section and an opposite second end, wherein the passageway has a cone-shaped portion having a decreasing diameter as the distance from the first end of the passageway increases;

an intermediate section opposite to the bearing surface and between the bolt receiving section and the cable receiving section, the intermediate section comprising a cut out in base of the intermediate portion, the cut out extending from the first open end of the passageway toward the bolt receiving section and terminating at a riser, wherein the length of the cut out measured between the riser and the first open end of the passageway is defined as a riser distance; and a locking tube having a cylindrical outer shape, a first end, an opposite second end, and a longitudinal axis extending from the first end to the second end of the locking tube, wherein the first end of the locking tube lies in a first plane generally normal to the longitudinal axis of the locking tube and the second end of the locking tube lies in a second plane that subtends an acute angle with the longitudinal axis of the locking tube to provide outer surface of the locking tube with a truncated cylindrical shape and to provide the locking tube with a first length and a second length, wherein the first length of the locking tube (a) is a longest distance between the first end and the second end of the locking tube, (b) is longer than the second length of the locking tube, and (c) is longer than the riser distance, and the second length of the locking tube is a shortest distance between the first end and the second end of the locking tube, wherein the first length is measured along a first imaginary line and the second length is measured along a second imaginary line, wherein the first and the second imaginary lines and the longitudinal axis of the locking tube lie in a third plane and the first and the second imaginary lines are parallel to one another, and wherein the first end of the locking tube is sized to fit into the first open end of the passageway of the cable engaging section, wherein having the first end of the locking tube in the first open end of the passageway and an outer surface portion of the locking tube having the second length of the locking tube in the cut out, the second end in the cut out is spaced from, and out of contact with, the riser, and rotation of the locking tube in the cut out continuously decreases the distance between the second end of the locking tube and the riser to move the second end of the locking tube having the first length into contact with the riser.

4. The truss shoe according to claim 3, wherein the cone shaped portion of the passageway comprises a first end and an opposite second end with the first end of the cone-shaped portion adjacent the first open end of the passageway, the passageway further comprises a circular portion having a constant diameter to receive the first end of the locking tube, the circular portion between the first end of the cone-shaped portion and the first open end of the passageway, wherein diameter of the circular portion is greater than diameter of the first end of the cone-shaped portion to provide a ledge between the cone shaped portion and the circular portion, and the cut out portion is a radius cut out portion having a radius that is about equal to the radius of the circular portion.

5. The truss shoe according to claim 4, wherein transition between the circular portion and the cut out portion is a seamless transition.

6. The truss shoe according to claim 5, wherein the cone-shaped portion is a first cone-shaped portion and further comprising a second cone-shaped portion between the first cone-shaped portion and the second end of the passageway, wherein the second cone-shaped portion has an increasing diameter as the distance from the second end of the passageway decreases.

7. The truss shoe according to claim 6, wherein the circular portion is a first circular portion and further comprising a second circular portion having a constant diameter, wherein the second circular portion is between the first and the second cone-shaped portions.

8. The truss shoe according to claim 7, wherein the second cone-shaped portion has a first end and a second end with the first end of the second cone-shaped portion adjacent the second circular portion, and diameter of the first end of the second cone-shaped portion and the second circular portion are substantially equal and the transition of the first end of the second cone-shaped portion and the second circular portion is a seamless transition.

9. The truss shoe according to claim 3, wherein the cone shaped portion comprises a first end and an opposite second end with the first end of the cone-shaped portion adjacent the first open end of the passageway, the passageway further comprises a circular portion having a constant diameter, the circular portion between the first end of the cone-shaped portion and the first open end of the passageway, wherein diameter of the circular portion is greater than diameter of the first end of the cone-shaped portion to provide a ledge between the cone shaped portion and the circular portion, and the cut out portion is a radius cut out portion having a radius that is about equal to the radius of the circular portion, and wherein the locking tube has a circular outer surface having a diameter generally equal to the inside diameter of the circular portion, and the first end of the locking tube is in the circular portion against the ledge and the second end of the locking tube having the first length engages the riser to secure the locking member to the truss shoe.

10. The truss shoe according to claim 9, further comprising a cone-shaped cable retention assembly in the cone-shape portion of the passageway, the cone-shaped retention member comprising at least two pieces held together by a flexible band, wherein the locking tube prevents movement of the retention member out of the first end opening of the passageway.

11. The truss shoe according to claim 10, further comprising a portion of a cable in the passageway and a portion of the cable captured in the cable retention assembly, wherein inside diameter of the locking tube is greater than outside diameter of the cable.

12. The truss shoe according to claim 10, wherein the intermediate section further comprises a pair of spaced strengthening ribs between and connecting the bolt receiving section and the cable retention section, wherein the cut out is between the ribs, and the cable retention assembly includes an expander between the two pieces of the cable retention assembly.

13. The truss shoe according to claim 12, wherein the bore hole of the bolt receiving section has a first end opening at the bearing surface that is non-circular and an opposite second end opening that is circular, wherein (1) the second end opening of the bore hole of the bolt receiving section has a decreasing radius from the second end opening of the bore hole to a position within the borehole spaced a predetermined distance from the second opening of the bore hole, and (2) a wall portion of the bore hole lies on a line extending from the first end of the bore hole to the second end of the bore hole defined as a first line, wherein the first line and a plane containing the bearing surface subtend a predetermined angle, and a wall portion of the bore hole lies on a line extending from the first end of the bore hole to the second end of the bore hole defined as a second line, wherein the first line and the second line are opposite one another, and the second line and a plane containing the bearing surface subtend an angle less than the predetermined angle.

14. The truss according to claim 3, wherein the cone-shaped portion is a first cone-shaped portion and further comprising a second cone-shaped portion between the first cone-shaped portion and the second end of the passageway, wherein the second cone-shaped portion has an increasing diameter as the distance from the second end of the passageway decreases, and the length of the second cone-shaped portion is equal to about at least 75% of the first cone-shaped portion of the passageway and the second open end of the passageway has a beveled inside surface adjacent the bearing surface of the base member, wherein the circular portion is a first circular portion and further comprising a second circular portion having a constant diameter, wherein the second circular portion is between the first and the second cone-shaped portions, wherein the second cone-shaped portion has a first end and a second end with the first end of the second cone-shaped adjacent the second circular portion, and diameter of the first end of the second cone-shaped portion and the second circular portion are substantially equal and the transition of the first end of the second cone-shaped and the second circular portion is a seamless transition.

15. The truss shoe according to claim 14, further comprising a wedge assembly comprises an outer cone shape and an inner circular passage, at least two discrete segments secured together by a biasing band, the wedge assembly sized to fit within the first end of the cable receiving section, with larger end of the wedge assembly having a greater diameter than the diameter of the circular portion.

16. The truss shoe according to claim 15, wherein the locking tube has a passageway sized to retain the wedge assembly in the passageway while allowing an expander mounted in the wedge assembly to pass therethrough.

17. The truss shoe according to claim 3, wherein the outer surface of the locking tube is a surface selected from the group of surface having a roughened surface and a surface having a plurality of spaced grooves.

18. A truss shoe for use in a mine roof support system, the truss shoe comprising:

a one-piece body member, comprising:

a base member comprising a bearing surface for engaging a mine roof;

a bolt receiving section extending upward from the base member, the bolt receiving section comprising a bore hole extending through the bolt receiving section and the base member, wherein the bore hole of the bolt receiving section has a first end opening at the bearing surface that is non-circular and an opposite second end opening that is circular;

a cable engaging section spaced from the bolt receiving section, the cable receiving section having a passageway therethrough to receive a portion of a cable, and the cable engaging section comprises a housing extending upward from the base member and having a first open end facing the bolt receiving section and an opposite second open end, with the passageway between the first end and the second end, the passageway having decreasing distance between wall portions as the distance from the first open end increases to provide a passageway having a predetermined interior surface configuration; and an intermediate section between the bolt receiving section and the cable engaging section, the intermediate section comprising a pair of spaced ribs between and interconnecting the bolt receiving section and the cable engaging section, and a cut out groove between the ribs, the cut out groove extending from the first open end of the passageway toward the bolt receiving section and terminating at a riser;

a wedge assembly comprising at least two parts mounted in the passageway;

an expander mounted in the wedge assembly; and a locking tube having a first end and an opposite sloped oval-shaped second end to provide the locking tube with a truncated cylindrical shape, wherein the wedge assembly in the passageway and the locking tube in the cut out groove are in an unsecured position when the locking tube is in the cut out groove, the first end of the locking tube is in the first open end of the passageway and the oval shaped second end of the locking tube is in facing relationship to a surface of the cut out groove, and the wedge assembly is in a secured position in the passageway and the locking tube is in a secured position in the cut out groove when the locking tube is in the cut out groove, the first end of the locking tube is in the first open end of the passageway and the oval shaped second end faces away from the surface of the cut out groove, wherein any degree of rotation of the locking tube when in the cut out groove increases or decreases the spaced distance between the second end of the locking tube and the riser, wherein the locking tube has an inside diameter and outside diameter sized to retain the wedge assembly in the passageway while allowing the expander to pass through the locking tube.

19. The truss shoe according to claim 18, wherein the wedge assembly comprises a plurality of surface engaging members on inner surface of the wedge assembly and angled toward the larger end of the wedge assembly.

20. The truss shoe according to claim 19, wherein the base member further comprises an arcuate end adjacent the bore receiving section.

21. The truss shoe according to claim 19, wherein the base member further comprises a first major surface and an opposite second major surface, a first side and an opposite second side, with the first side longer than the second side, and a first end joining the first side and the second side, the first end having a curved peripheral surface and an opposite second end joining the first and the second sides, wherein the first major surface of the first end is larger than the second major surface of the second end, and peripheral edge of the first end is curved to provide a sweeping radius.

22. The truss shoe according to claim 18, wherein the pair of ribs comprise a first rib and a second rib, the first rib comprising a bottom portion and a top portion; the bottom portion having an end extending and connected to the cable receiving section, and an opposite end extending and connected to the bolt receiving section; the bottom portion of the first rib extending to an adjacent side of the base of the truss shoe; sloping sides extending between the bottom and the top portions; the top portion extending between and connected to the cable receiving section and the bolt receiving section, and ending short of the cut out, and the second rib comprising a bottom portion and a top portion; the bottom portion of the second rib having an end extending and connected to the cable receiving section, and an opposite end extending and connected to the bolt receiving section; the bottom portion of the second rib extending to a side of the base of the truss shoe adjacent to the second rib; sloping sides extending between the bottom and the top portions of the second rib; the top portion of the second rib extending between and connected to the cable receiving section and the bolt receiving section, and ending short of the cut out.

* * * * *